US010072423B2

(12) United States Patent
LeVey

(10) Patent No.: US 10,072,423 B2
(45) Date of Patent: Sep. 11, 2018

(54) COMPRESSIBLE FOAM CLOSURE FOR METAL ROOFS

(71) Applicant: Atlas Bolt & Screw Company LLC, Ashland, OH (US)

(72) Inventor: Kenneth LeVey, Chicago, IL (US)

(73) Assignee: ATLAS BOLT & SCREW COMPANY LLC, Ashland, OH (US)

( * ) Notice: Subject to any disclaimer, the term of this patent is extended or adjusted under 35 U.S.C. 154(b) by 0 days.

(21) Appl. No.: 15/200,295

(22) Filed: Jul. 1, 2016

(65) Prior Publication Data

US 2017/0198479 A1 Jul. 13, 2017

Related U.S. Application Data

(60) Provisional application No. 62/276,573, filed on Jan. 8, 2016.

(51) Int. Cl.

| | |
|---|---|
| ***E04D 13/16*** | (2006.01) |
| ***E04B 1/68*** | (2006.01) |
| ***E04B 1/72*** | (2006.01) |
| ***E04D 5/06*** | (2006.01) |
| ***E04D 13/00*** | (2006.01) |
| ***E04D 13/17*** | (2006.01) |

(52) U.S. Cl.

CPC ..... *E04D 13/1618* (2013.01); *E04B 1/6812* (2013.01); *E04B 1/72* (2013.01); *E04D 5/06* (2013.01); *E04D 13/004* (2013.01); *E04D 13/17* (2013.01); *E04D 13/174* (2013.01); *E04D 13/176* (2013.01)

(58) Field of Classification Search

CPC ..... E04D 12/00; E04D 5/06; E04D 13/1618; E04D 13/004; E04D 13/1612; E04D 13/176; E04B 1/6812; E04B 1/72

USPC ..... 52/406.1, 406.2, 309.4, 309.5, 309.12

See application file for complete search history.

(56) References Cited

U.S. PATENT DOCUMENTS 2,799,494 A * 7/1957 Pollock ..... B63B 59/02 104/30
4,021,981 A * 5/1977 Van Wagoner ..... E04D 3/352 156/71

(Continued)

FOREIGN PATENT DOCUMENTS

DE 8509604 U1 7/1985
DE 9209275 U1 9/1992

(Continued)

OTHER PUBLICATIONS

International Search Report issued by ISA/EPO in connection with PCT/US2017/012146 dated Mar. 21, 2017.

(Continued)

*Primary Examiner* — Beth A Stephan

(74) *Attorney, Agent, or Firm* — Levenfeld Pearlstein, LLC

(57) ABSTRACT

A compressible foam closure for roof panels includes a core having an elongate body defining a longitudinal axis. The elongate body has at least two opposing sides and defines a thickness. A plurality of slits are formed in the core, into the thickness, extending from the at least two opposing sides toward the longitudinal axis. A thin, flexible, water impermeable skin covers the core. The slits can be formed fully through the core to form slices of the core that are stacked together.

17 Claims, 5 Drawing Sheets

(56) References Cited

U.S. PATENT DOCUMENTS 4,110,881 A * 9/1978 Thompson ..... A47C 27/146
267/145
5,328,407 A * 7/1994 Sells ..... E04D 13/174
454/365
5,331,783 A * 7/1994 Kasner ..... E04D 13/174
454/364
5,537,699 A * 7/1996 Bonaddio ..... A47C 27/063
5/717
5,542,882 A * 8/1996 Sells ..... E04D 3/40
454/365
5,651,734 A * 7/1997 Morris ..... E04D 1/36
454/365
5,704,834 A * 1/1998 Sells ..... E04D 13/174
454/365
5,830,059 A * 11/1998 Sells ..... E04D 13/176
454/365
5,947,817 A * 9/1999 Morris ..... E04D 1/36
454/365
6,267,668 B1 * 7/2001 Morris ..... E04D 13/174
454/365
6,450,882 B1 * 9/2002 Morris ..... E04D 13/176
454/365
D465,839 S * 11/2002 Sells ..... E04D 1/36
D23/373
6,598,356 B1 7/2003 Sells
6,623,354 B2 * 9/2003 Morris ..... E04D 13/176
454/365
9,249,571 B1 * 2/2016 White ..... E04C 2/292
2002/0193065 A1 * 12/2002 Morris ..... B01D 53/8643
454/257
2004/0132401 A1 7/2004 Rotter
2004/0187412 A1 * 9/2004 McCain ..... B32B 7/06
52/233
2005/0102929 A1 * 5/2005 Hoffmann ..... B65G 69/008
52/173.2
2007/0117505 A1 * 5/2007 Wey ..... E04D 13/176
454/366
2008/0287054 A1 11/2008 Carlson et al.
2009/0064605 A1 * 3/2009 Hoffman ..... B65G 69/008
52/173.2
2009/0114438 A1 * 5/2009 van Haaster ..... H05K 9/0015
174/356

FOREIGN PATENT DOCUMENTS

DE 4414211 A1 10/1995
EP 0320343 A1 6/1989

OTHER PUBLICATIONS

International Preliminary Report on Patentability issued by International Bureau of WIPO in connection with PCT/US2017/012146 dated Jul. 10, 2018.

* cited by examiner

COMPRESSIBLE FOAM CLOSURE FOR METAL ROOFS

CROSS-REFERENCED TO RELATED APPLICATION DATA

This application claims the benefit of and priority to Provisional U.S. Patent Application Ser. No. 62/276,573, filed Jan. 8, 2016, the disclosure of which is incorporated herein in its entirety.

BACKGROUND

The present disclosure relates closures for roofs and more particularly, to closures for metal roofs. Metal roofs are commonly used on all types of buildings. Metal roofs are available in a wide variety of shapes and can include corrugated, box beam, box rib, B-deck, V-beam and a host of other shapes. The panels are mounted to a roof structure. In a typical pitched installation, the panels are mounted such that the channels or corrugations are oriented vertically or at an angle, or so that water flows off of the roof.

The roof panels are joined to one another or to another member, such as a ridge cap. A seal is positioned at the juncture of the panels or the panel and the ridge cap. The seal prevents in-leakage of water (e.g., wind-driven rain), dirt and other contaminants, vermin and the like.

Known seals include a foam element, such as a closed cell foam, that is positioned between the panels or between the panel and the ridge cap. Foam closures can take the form of a non-shaped sheet, block or strips. In such an installation, the foam element is positioned between the roof panels (that is above a lower panel and below an upper panel), to establish the seal.

Other foam closures are fabricated to form or conform to a specific roof panel shape and size. That is, a roof panel that has, for example, a certain V-shaped cross-section, may be used with a foam element that is convoluted, having a corresponding V-shape with the dimensions of the foam the same as the dimensions of the panel's V-shaped cross-section.

The foam strips can include an adhesive to help maintain the strip in place, and can be formed from foamed polyethylene, ethylene propylene diene monomer rubber (EPDM), and like materials. When made into foam members, the foams are formed as closed cell foams.

While these seals usually function well for their intended purpose, there are drawbacks. First, the sheet, block or strip foam element many not fully conform to the shape of the roof panels. This, of course, can result in gaps or openings between the panels or at the panel joints that do not prevent in-leakage, contaminant ingress, vermin and the like.

The formed foam members, overcome the gap problem, but require that the foam element be fabricated specifically for the type, shape and size of the roof panel corrugation.

Accordingly, there is a need for roof panel seal element that readily conforms to the size and shape of the roof panels with which it is used. Desirably, such a seal element can be used along and across the panel corrugations.

SUMMARY

Various embodiments of the present disclosure provide a compressible foam closure for roof panels. The closure includes a core having an elongate body defining a longitudinal axis. The elongate body has at least two opposing sides and defines a thickness.

A plurality of slits are formed in the core, into the thickness. The slits extend from the at least two opposing sides toward the longitudinal axis. A thin, flexible, water impermeable skin covers the core.

In an embodiment, the slits are formed having a defined width, such that portions of the core adjacent to the slit are spaced from one another. In an embodiment, the core has a stretched or elongated hexagonal cross-sectional shape defining a major axis and a minor axis. The slits are formed in the body parallel to the major axis.

In another embodiment, the core has an elongated diamond cross-sectional shape that defines a major axis and a minor axis, and the slits are formed in the body parallel to the major axis. The slits that extend from one side can be staggered with the slits that extend from the opposite side. In embodiment, at least some of the slits extend beyond the longitudinal axis.

In an embodiment, the slits extending from one side are coincident with the slits extending from the opposite side. The slits can extend almost to the longitudinal axis. In an alternate embodiment the slits extending from one side are staggered or alternating with the slits extending from the opposite side. In this embodiment the slits can extend to and beyond the longitudinal axis.

In an embodiment, the core is formed from a foam material. The foam can be a closed cell elastomeric foam. In an embodiment, the skin is formed from butyl rubber.

In an embodiment, a release sheet is present on the thin, flexible, water impermeable skin. The release sheet can be formed with edges that extend beyond edges of the thin, flexible, water impermeable skin to facilitate handling the closure In an embodiment, the closure includes a core formed from a plurality of singulated slices that are assembled into a stack of slices to form the core. The core has an elongate body that defines a longitudinal axis. The body has at least two opposing sides and defines a thickness. In an embodiment, the slices are substantially identical to one another in cross-sectional shape. A thin, flexible, water impermeable skin covers the core. In an example, the slices have a thickness and the thicknesses of each slice are about equal.

These and other features and advantages of the present disclosure will be apparent from the following detailed description, in conjunction with the appended claims.

BRIEF DESCRIPTION OF THE DRAWINGS

FIGS. 1A-1C illustrate various types of roof panel constructions, in which FIG. 1A illustrates a metal roof deck with an embodiment of a compressible foam closure;

DETAILED DESCRIPTION

Figure 1A:
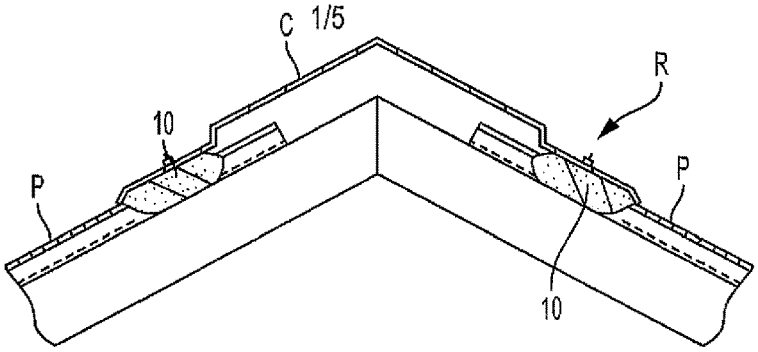

While the present disclosure is susceptible of embodiments in various forms, there is shown in the drawings and will hereinafter be described one or more presently preferred embodiments with the understanding that the present disclosure is to be considered an exemplification and is not intended to limit the disclosure to the specific embodiment or embodiments illustrated.

Figure 1B:
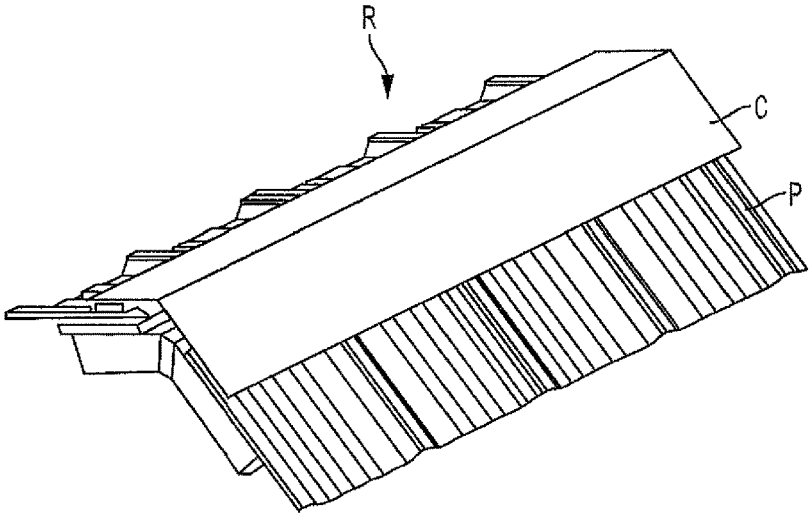
Figure 1C:
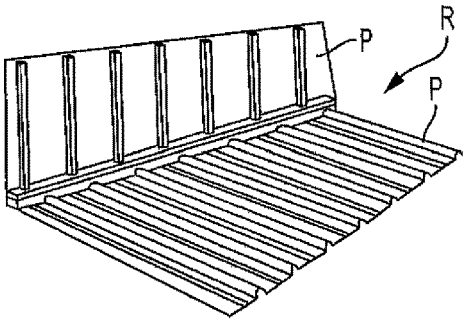

Referring now to the figures and in particular to FIG. 1 there is illustrated one example of pitched metal roof system R. The roof system R includes metal roof panels P, a closure cap C and an embodiment of a compressible foam closure 10 between the panels P and the closure cap C. The illustrated panels P can be of the corrugated type, box beam, box rib, B-deck, V-beam or any other manufactured or to be manufactured shapes.

Figure 2:
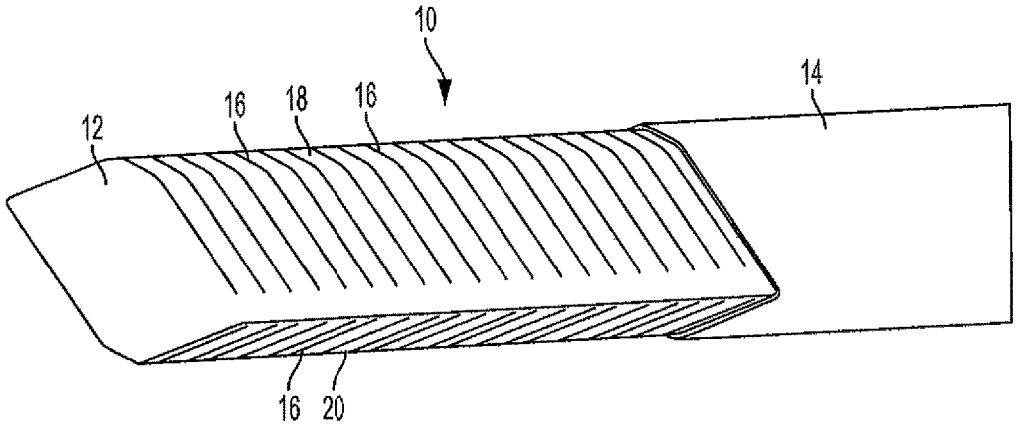
FIG. 2 is a perspective illustration of an embodiment of the compressible foam closure.
Figure 3:
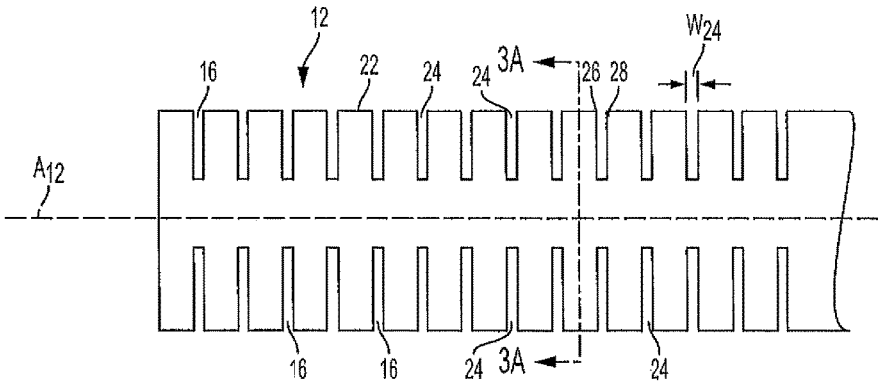
FIG. 3 is a front view of the compressible foam closure of FIG. 2.
Figure 3A:
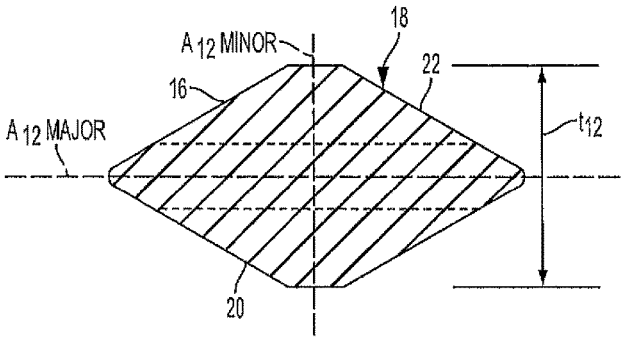
FIG. 3A is a cross-sectional view taken along line 3A-3A in FIG. 3.

An embodiment of the compressible foam closure 10 is illustrated in FIGS. 2 and 3-3A. The closure 10 includes a relatively rigid elongate core 12 and an outer skin or covering 14 formed from a softer, more pliable material. In an embodiment, the core 12 material is an elastomeric material, such as a closed cell elastomeric foam and the outer covering 14 is a butyl rubber material. The outer covering 14 can be relative thin and flexible. It will be appreciated that a material such as butyl rubber permits the compressible closure to bend and flex so as to conform to the shape of the metal roof panels P, is relatively sticky so that it remains in place (for example, during installation), and is water and air impermeable. In an embodiment, the outer covering or skin 14 is adhered to the core 12 by, for example, an adhesive A.

Referring to FIGS. 1, 3 and 3A, the body or core 12 of the closure 10 defines a longitudinal axis $A_{12}$ along its length. The core 12 has a plurality of transverse cuts or slits 16 in the body 12, in a direction transverse to the longitudinal axis $A_{12}$. The core 12 has at least a pair of opposing sides 18, 20 and a thickness $t_{12}$. In the illustrated embodiment, the core 12 has a stretched or elongated hexagonal cross-section defining a major axis $A_{12major}$ and a minor axis $A_{12minor}$. The core 12 is symmetrical about both the major and minor axes $A_{12major}$ and $A_{12minor}$, and the thickness $t_{12}$ of the core is as viewed along the minor axis $A_{12minor}$. The cuts or slits 16 in the core 12 are into the core 12, parallel to the major axis $A_{12major}$ and extend from the surface 22 of the core 12, on both (or opposing) sides 18, 20 relative to the longitudinal axis $A_{12}$, toward the longitudinal axis $A_{12}$. In an embodiment, the cuts 16 are made so as form channels 24 (having a defined width $W_{24}$) in the core 12, and are made relative deeply into the core 12 (that is close to the longitudinal axis $A_{12}$). In this manner the portions 26, 28 of the core 12 on either side of a channel 24 are spaced from one another.

Figure 4:
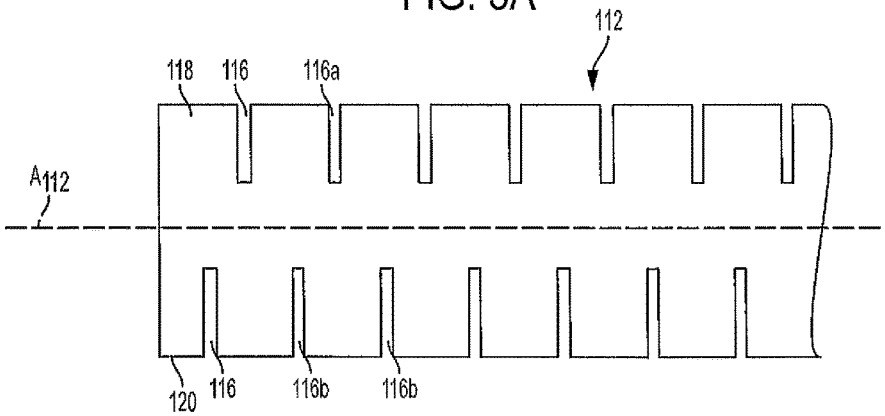
FIG. 4 is a front view of an alternate embodiment of the compressible foam closure.

Referring to FIG. 3, in an embodiment, the cuts 16 are coincident with one another, that is aligned top and bottom. Alternately, as seen in FIG. 4, the cuts 116 can be staggered or alternating so that a cut 116*a* into the upper part 118 of the core 112 is between cuts 116*b* in the lower part 120 of the core 112 and vice-versa. The cuts 116*a*, 116*b* can be relatively shallow or they can be deeper, toward the longitudinal axis $A_{112}$.

It is also contemplated that in an embodiment of the core 112 in which the cuts 116*a*, 116*b* are staggered or alternating, the cuts 116*a*, 116*b* may extend beyond the longitudinal axis $A_{112}$. It will be understood that many such configurations can be effected with one another. That is the cuts 16, 116 can be deep and coincident (not extending to the longitudinal axis $A_{12}$, $A_{112}$), deep and staggered or alternating (and can extend beyond the longitudinal axis $A_{12}$, $A_{112}$), shallow and coincident and shallow and staggered or alternating.

Figure 5A:
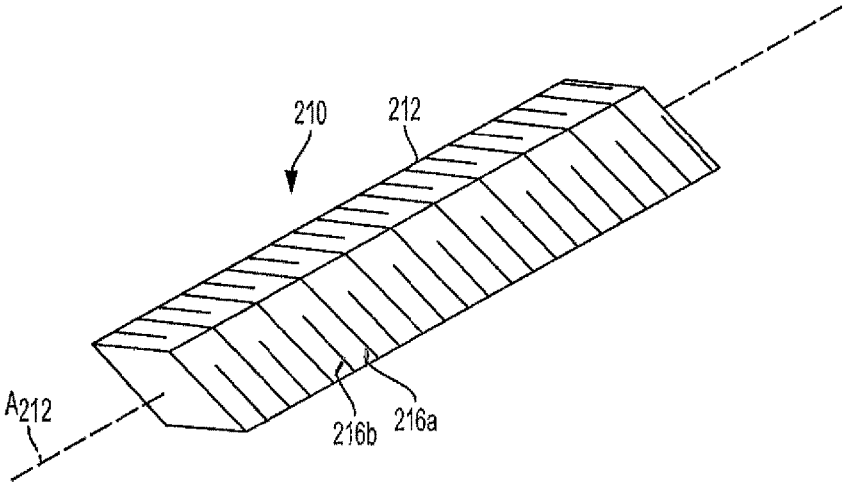
FIGS. 5A-5C are perspective, front and sectional views of another alternate embodiment of the compressible foam closure.
Figure 5B:
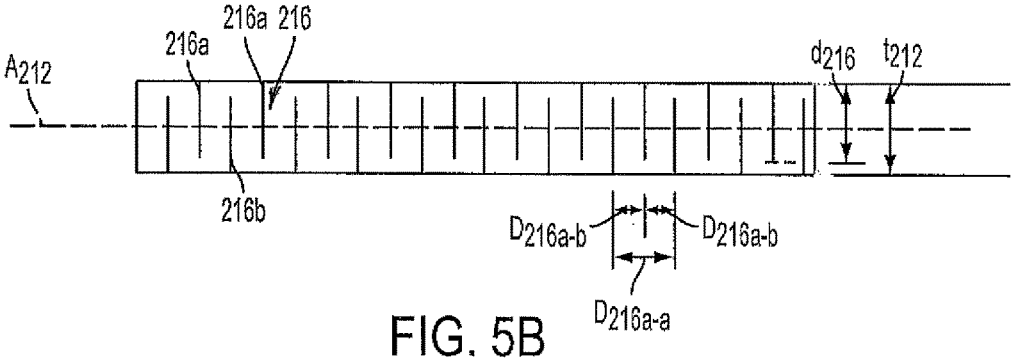
Figure 5C:
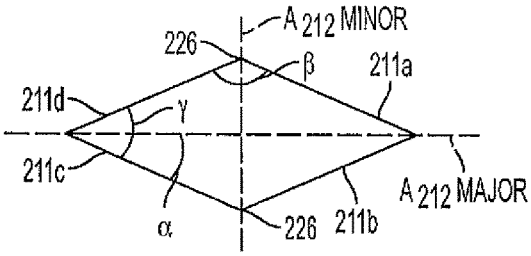

For example, still another embodiment of the core 212 of the compressible foam closure 210 is illustrated in FIGS. 5A-5C. In this embodiment, the core 212 has a four-sided (211*a*-211*d*) cross-sectional shape, such as the illustrated diamond or stretched (or elongated) diamond shape, defining a longitudinal axis $A_{212}$ (along the length of the core 212) and major and minor axes $A_{212major}$ and $A_{212minor}$. The elongated diamond shape defines a pair of opposing obtuse angles β and a pair of opposing acute angles γ. In the illustrated embodiment, the cuts 216 are staggered or alternating formed into opposing apexes 226 of the core 212. Again, the cuts or slits 216 can be deep, for example extending through and beyond the longitudinal axis as illustrated or the cuts can be shallower, not extending to the longitudinal axis.

Examples of various core 212 dimensions across the major and minor axes $A_{212major}$ and $A_{212minor}$, and core angles (α, β, γ), distances between cuts or slits (216*a* to 216*a*, which is shown as $D_{216a\text{-}a}$; 216*b* to 216*b*, which is shown as $D_{216b\text{-}b}$; and 216*a* to 216*b*, which is shown as $D_{216a\text{-}b}$) in inches, and depths of cuts or slits ($d_{216}$) in inches, for the embodiment of FIGS. 5A-5C are provided in Table 1 below.

TABLE 1

EXAMPLE DIMENSIONS FOR COMPRESSIBLE FOAM CLOSURES

| Major axis (in.) | Minor Axis (in.) | Ref. angle (α in deg.) | Dist. between slits 216a to 216a ($D_{216a\text{-}a}$) and 216b to 216b ($D_{216b\text{-}b}$) (in.) | Dist. between slits 216a to 216b ($D_{216a\text{-}b}$) (in.) | Depth of slits ($d_{216}$) (in.) |
|---|---|---|---|---|---|
| 2.595 | .910 | 19.32 | 0.750 | 0.375 | 0.735 |
| 2.574 | .968 | 20.62 | 0.750 | 0.375 | 0.793 |
| 2.563 | 1.063 | 22.75 | 0.750 | 0.375 | 0.888 |
| 2.287 | 1.527 | 33.72 | 0.750 | 0.375 | 1.352 |

It will be understood that in the above examples, the minor axis dimension ($A_{212minor}$) is equal to the core thickness $t_{212}$ and the reference angle α, is one-half (½) of the acute angle γ.

Figure 6:
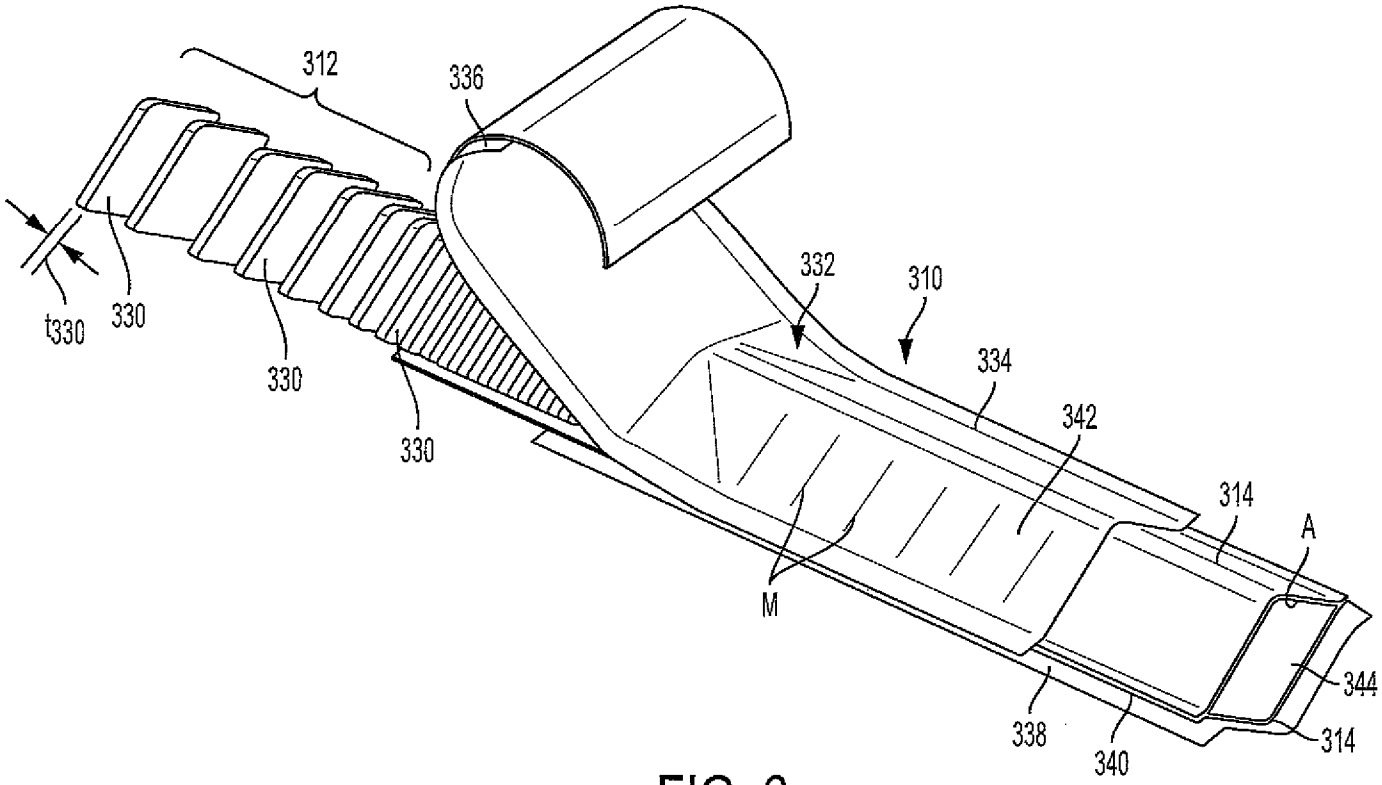
FIG. 6 is a perspective illustration of still another embodiment of the compressible foam closure.

Still another embodiment of the compressible foam closure 310 is illustrated in FIG. 6. In this embodiment, the core 312 is formed from individual or singulated slices 330 of material, such as a closed cell foam, that are stacked together to form the core 312. The foam slices 330 can take the shapes as described above, for example, a four-sided cross-sectional shape, such as the illustrated diamond or stretched (or elongated) diamond shape. The slices 330 are singulated, that is the slices 330 are separated from one another and placed face-to-face, between the outer coverings 314. In an embodiment, the outer covering 314 is formed from a pair of tapes, e.g., upper and lower tapes, that can be formed from a relative thin, flexible material, such as a butyl rubber material. As noted above, a material such as butyl rubber permits the compressible closure 310 to bend and flex so as to conform to the shape of the metal roof panels P, is relatively sticky so that it remains in place (for example, during installation), and is water and air impermeable. The outer covering 314 can be adhered to the core 312 by, for example, an adhesive A.

In an embodiment, a release sheet or like member 332 is positioned on the outer covering 314. The release sheet 332 can be, for example, a paper sheet 334 with a release layer 336, such as silicone, on a surface in contact with the outer covering 314. The release sheet 332 provides a measure of protection for the outer covering 314. In that the outer covering 314 may be made from a material that is "sticky", the release sheet 332 protects the outer covering from collecting dirt, debris and the like. In addition, the release sheet 332 also serves to facilitate handling and placement or installation of the closure 310. In an embodiment, the release sheet 332 has edges 338 that extend beyond the transverse edges 340 of the outer covering 314 so that the release sheet 332 is easily grasped by the overhanging edges 338 and removed from the closure 310 for installation. It will be appreciated that the release sheet can be used with any of the closures disclosed herein.

The singulated slices 330 that form the core 312 can be formed with a variety of thicknesses $t_{330}$. The thicknesses $t_{330}$ can be constant or can change along the length $l_{310}$ of the closure 310. 21. In an embodiment, the slices 330 are substantially identical to one another in cross-sectional shape. An outer surface 342 of the release sheet 332 can be provided with markings M, such as distance (length) markings to facilitate measuring and cutting the closure 310 as needed.

It will also be appreciated that the outer covering 14, 314, when formed from a material such as a butyl rubber material, is sticky and will stick to itself, as well as other materials. As such, an end 344 of the closure 10, 110, 210, 310 can be closed by pinching the material onto itself beyond an end of the core 312. In this manner, the end of the closure 10, 110, 210, 310 can be sealed to prevent the ingress of moisture, debris, dirt and the like.

It will be appreciated that the cuts or slits 16, 116, 216 in the core 12, 112, 212 and the slices 330 of the core 312 provide a measure of flexibility to the core material that a solid member might not otherwise afford. That is, a solid member may not be able to flex and conform to the size and shape of the roof panel P convolutions, whereas the cuts or slits 16, 116, 216 in the core 12, 112, 212 and the slices 330 of the core 312 allow the core 12, 112, 212, 312 to be bent or molded into a desire shape. Thus, the core 12, 112, 212, 312 conforms to the profile of the roof panels P and the flexible outer skin or covering 14, 314 contacts the panels P, such that the combination of the core 12, 112, 212, 312 and outer covering 14, 314 together provide resistance to environmental factors as well as resistance to vermin incursion.

Those skilled in the art will appreciate that although a hexagonal-shaped closure 10, 110, 210, 310 is shown the closure 10, 110, 210, 310 (and specifically, the closure core 12, 112, 212, 312) can take many cross-sectional shapes, such as the illustrated elongated hexagonal shape and the elongated diamond shape, as well as rectangular shapes, oval shapes, and the like, all of which shapes are within the scope and spirit of the present disclosure.

In the present disclosure, the words "a" or "an" are to be taken to include both the singular and the plural. Conversely, any reference to plural items shall, where appropriate, include the singular. All patents and published applications referred to herein are incorporated by reference in their entirety, whether or not specifically done so within the text of this disclosure.

It will also be appreciated by those skilled in the art that the relative directional terms such as sides, upper, lower, top, bottom, rearward, forward and the like are for explanatory purposes only and are not intended to limit the scope of the disclosure.

From the foregoing it will be observed that numerous modifications and variations can be effectuated without departing from the true spirit and scope of the novel concepts of the present disclosure. It is to be understood that no limitation with respect to the specific embodiments illustrated is intended or should be inferred. The disclosure is intended to cover by the appended claims all such modifications as fall within the scope of the claims.

What is claimed is:

1. A compressible foam closure for roof panels, comprising:

a core having an elongate body defining a longitudinal axis, the elongate body having at least two opposing sides and defining a thickness;

a plurality of slits formed in the core, into the thickness, extending from the at least two opposing sides perpendicular to the longitudinal axis; and a thin, flexible, water impermeable skin covering an entirety of the core.

2. The compressible foam closure of claim 1, wherein the slits are formed having a defined width, such that portions of the core adjacent to the slit are spaced from one another.

3. The compressible foam closure of claim 1, wherein the core has an elongated hexagonal cross-sectional shape defining a major axis and a minor axis, and wherein the slits are formed in the body parallel to the major axis.

4. The compressible foam closure of claim 1, wherein the slits extend toward, but not to, the longitudinal axis.

5. The compressible foam closure of claim 1, wherein the slits extending from one of the sides are coincident with the slits extending from an opposite side.

6. The compressible foam closure of claim 1, wherein the slits extending from one of the sides are staggered with the slits extending from an opposite side.

7. The compressible foam closure of claim 6, wherein the slits extend to the longitudinal axis.

8. The compressible foam closure of claim 7, wherein at least some of the slits extend beyond the longitudinal axis.

9. The compressible foam closure of claim 1, wherein the core is formed from a foam material.

10. The compressible foam closure of claim 9, wherein the core is formed from a closed cell elastomeric foam.

11. The compressible foam closure of claim 1, wherein the skin is formed from butyl rubber.

12. The compressible foam closure of claim 1, wherein the core has an elongated diamond cross-sectional shape defining a major axis and a minor axis, and wherein the slits are formed in the body parallel to the major axis.

13. The compressible foam closure of claim 12, wherein the slits extending from one side are staggered with the slits extending from the opposite side.

14. The compressible foam closure of claim 13, wherein at least some of the slits extend beyond the longitudinal axis.

15. The compressible foam closure of claim 1 including a release sheet on the thin, flexible, water impermeable skin.

16. The compressible foam closure of claim 15 wherein the release sheet has edges that extend beyond edges of the thin, flexible, water impermeable skin.

17. The compressible foam closure of claim 1 wherein the core is four-sided.

* * * * *